United States Patent [19]

Reynolds

[11] Patent Number: 4,927,380

[45] Date of Patent: May 22, 1990

[54] PRINTED CIRCUIT BOARD CONNECTOR

[75] Inventor: Howard Reynolds, Waterbury, Conn.

[73] Assignee: The Siemon Company, Watertown, Conn.

[21] Appl. No.: 289,546

[22] Filed: Dec. 23, 1988

[51] Int. Cl.[5] ..... H01R 4/24

[52] U.S. Cl. ..... 439/411

[58] Field of Search ..... 439/389–426

[56] References Cited

U.S. PATENT DOCUMENTS

| | | | |
|---|---|---|---|
| 4,652,071 | 3/1987 | De Bortoli et al. | 439/412 |
| 4,741,480 | 5/1988 | Despault et al. | 439/412 |
| 4,764,125 | 8/1988 | De Bortoli et al. | 439/413 |

*Primary Examiner*—Joseph H. McGlynn

*Attorney, Agent, or Firm*—Fishman, Dionne & Cantor

[57] ABSTRACT

An electrical connector which is particularly useful in conjunction with printed circuit boards is presented. The connector is easy to assemble and therefore entails relatively low manufacturing costs. The connector of this invention is also easy to operate, permits a multiplicity of wiring changes over the product life and takes up very little area on the printed circuit board. In accordance with the present invention, the electrical connector is comprised of three main insulative component parts including a housing, a cover received in the housing and a screw mechanism which is captured in the cover and which functions to raise and lower the cover within the housing. The connector of this invention additionally includes a plurality of electrically conductive insulation displacement (IDC) type terminals which are received through the housing and which cooperate with appropriate openings in the cover. Thus, when an individual wire lead is inserted into one of the openings in the cover, the screw mechanism is actuated forcing the cover downwardly against a terminal whereupon an individual wire lead is terminated in a known manner.

19 Claims, 3 Drawing Sheets

PRINTED CIRCUIT BOARD CONNECTOR

BACKGROUND OF THE INVENTION

This invention relates generally to the field of electrical connectors for the termination of individual wire leads. More particularly, this invention relates to an electrical connector which utilizes a captivated screw mechanism for the termination of individual leads; and which is particularly well suited for use as a circuit board connector.

There is an ever present need in the marketplace for reliable and economical electrical connectors for use in connecting a plurality of individualized wire leads to a printed circuit board. Electrical connectors of this type should be small in size so as to take up a minimum amount of space on the printed circuit board and must be easy to use. Also, these electrical connectors should have the ability to be reusable. In other words, the multiplicity of wire leads should be disconnectable to and from the electrical connector.

While prior art electrical connectors for terminating individual wire leads to a printed circuit board are available, there is a perceived need for improved connectors of this type which are easier to use, have better reliability and are less expensive to manufacture.

SUMMARY OF THE INVENTION

The electrical connector of the present invention solves many of the problems of the prior art by providing a novel connector particularly useful in conjunction with printed circuit boards which is easy to assemble and therefore entails relatively low manufacturing costs. The connector of this invention is also easy to operate, permits a multiplicity of wiring changes over the product life and takes up very little area on the printed circuit board.

In accordance with the present invention, the electrical connector is comprised of three main component parts including an insulative housing, an insulative cover received in the housing and a screw mechanism which is captured in the cover and which functions to raise and lower the cover within the housing. The connector of this invention additionally includes a plurality of electrically conductive insulation displacement (IDC) type terminals which are received through the housing and which cooperate with appropriate openings in the cover. Thus, when an individual wire lead is inserted into one of the openings in the cover, the screw mechanism is actuated forcing the cover downwardly against a terminal whereupon an individual wire lead is terminated in a known manner.

Additional important features of the present invention include a snap-action means for retaining the electrical connector onto the surface of a printed circuit board as well as a novel means for providing stress relief to the individual wire leads subsequent to termination. The electrical connector of the present invention is particularly easy to operate since only a single screwdriver is needed to actuate the screw mechanism which depending on the direction turned, either connects or disconnects the wire leads from the IDC terminals.

The above discussed and other features and advantages of the present invention will be appreciated to and understood by those of ordinary skill in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
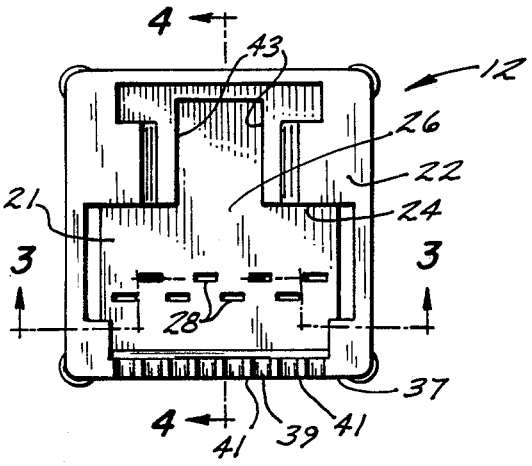
FIG. 1 is a plan view of the housing portion of the electrical connector of the present invention.
Figure 2:
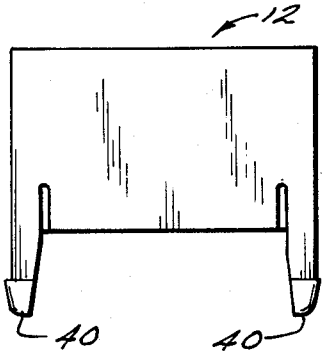
FIG. 2 is a side elevation view of the housing of FIG. 1.

Referring first simultaneously to FIGS. 1–15, an electrical connector is shown generally at 10. Connector 10 comprises four major components including a housing 12 (FIGS. 1–5), a cover insert 14 (FIGS. 6–11) received within housing 12, a screw mechanism 16 communicating between housing 12 and insert cover 14 and a plurality of electrically conductive terminals 18 which extend from the exterior of connector 10 through openings in both housing 12 and cover insert 14.

Figure 3:
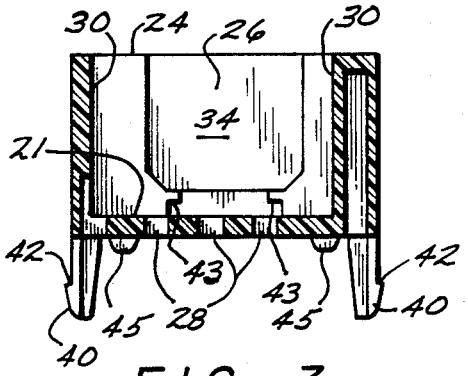
FIG. 3 is a cross-sectional elevation view along the line 3—3 of FIG. 1.
Figure 4:
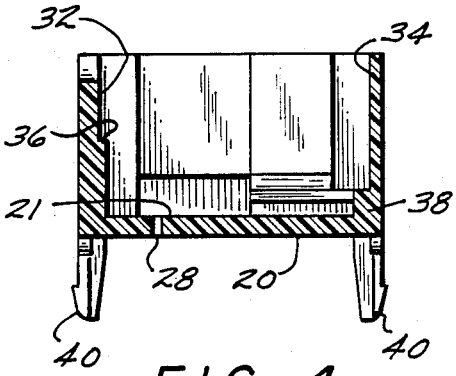
FIG. 4 is a cross-sectional elevation view along the line 4—4 of FIG. 1.
Figure 5:
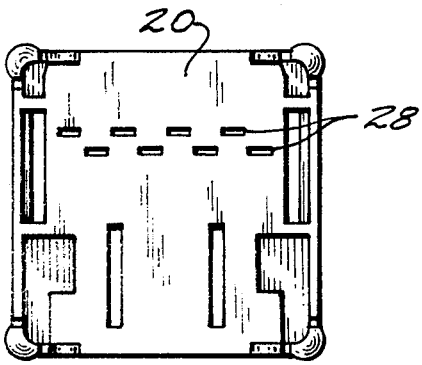
FIG. 5 is a bottom view of the housing of FIG. 1.

Referring now to FIGS. 1–5, housing 12 is substantially rectangular or square in shape and includes a rear closed surface 20 and a front surface 22 having an opening 24 therethrough to define an inner cavity 26 (see FIGS. 1, 3 and 4). Rear surface 20 of housing 12 includes a plurality of spaced openings 28 which are sized to frictionally engage one of a plurality of electrically conductive terminals 18 (see FIG. 14). Preferably, openings 28 are staggered in a zig-zag fashion to provide efficient and space saving placement of the terminals through the connector. Cavity 26 is defined by a pair of opposed end surfaces 30 and upper and lower side surfaces 32 and 34, respectively (as well as an interior surface 21 which is parallel to rear surface 20). As is evident from FIGS. 13A and 13B, lower and upper side surfaces 32 and 34 are each canterleavered outwardly at an angle of equal to or greater than 90° from rear surface 20. In addition, lower side surface 32 includes a shoulder 36 at about its mid section and upper side surface 34 includes a shoulder 38 at a relatively lower position closer to rear surface 20. The front wall of housing 12 includes a plurality of open ended grooves 39 defined by spaced walls 41. Housing 12 additionally includes four resilient hold downs 40. Each hold down 40 is located at a respective corner of the housing adjacent to rear surface 20. Each hold down 40 is sized to be received within appropriately spaced openings in a printed circuit board and includes a shelf 42 for retention within the circuit board as will be discussed hereinafter. In addition, a pair of opposed slots 43 are located along rear surface 20 and adjacent side surface 34. Slots 43 are sized to receive and retain an end of screw mechanism 16 (see FIG. 14). Rear surface 20 also includes four spaced standoffs 45.

Figure 6:
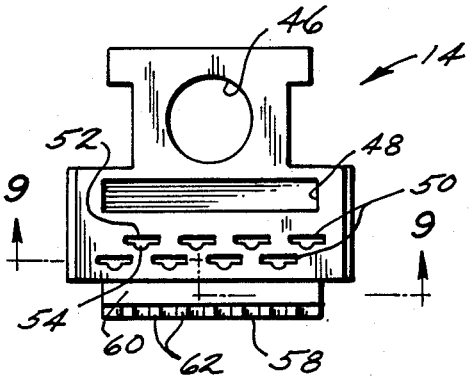
FIG. 6 is a plan view of the insert cover portion of the electrical connector of the present invention.
Figure 7:
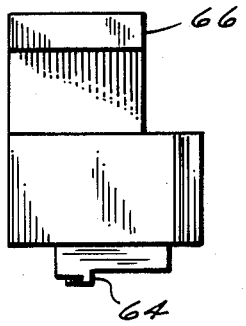
FIG. 7 is a side elevation view of the insert cover of FIG. 6.
Figure 8:
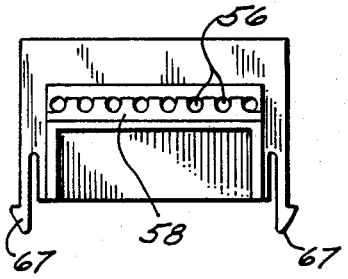
FIG. 8 is a front elevation view of the insert cover of FIG. 6.
Figure 9:
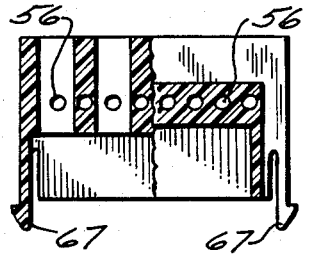
FIG. 9 is a cross-sectional elevation view along the line 9—9 of FIG. 6.
Figure 10:
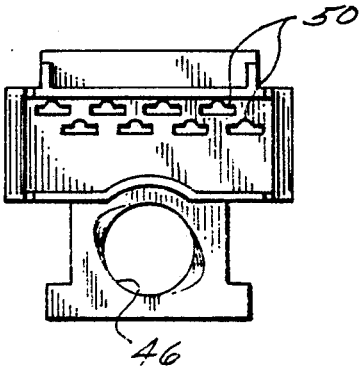
FIG. 10 is a bottom view of the insert cover of FIG. 6.
Figure 11:
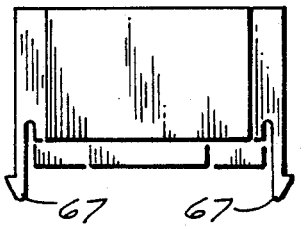
FIG. 11 is a rear elevation view of the insert cover of FIG. 6.

Referring now to FIGS. 6–11, 13 and 14 insert cover 14, has a front surface 44 having a generally "I" shape such as shown in FIG. 6 which corresponds to the shape of cavity 26 of body 12. A threaded hole 46 is provided completely through insert cover 14 in the stem portion of the "I". The threading and opening 46 is selected to mate with the threading on screw mechanism 16. The upper portion of "I" shaped insert cover surface 44 includes a rectangularly shaped recess 48 and a plurality of openings 50 which are spaced in facing relation to openings 28 in rear surface 20 of cover 12. As in openings 28, openings 50 are staggered to achieve efficient use of printed circuit board real estate. Each opening 50 is comprised of a rectangular section 52 which is sized to receive the head of a selected IDC connector terminal and a smaller semi-circular section 54 for receiving a test probe. As shown in FIGS. 8 and 9, insert cover 14 also includes a plurality of openings 56 which are transverse to and intersect with each of the openings 50. Each of the openings 56 extends through and terminate between recess 48 and the bottom side surface 58 of insert cover 14. It will further be appreciated that openings 56 have a size for receiving a conventional, typically insulated lead or wire.

Figure 12:
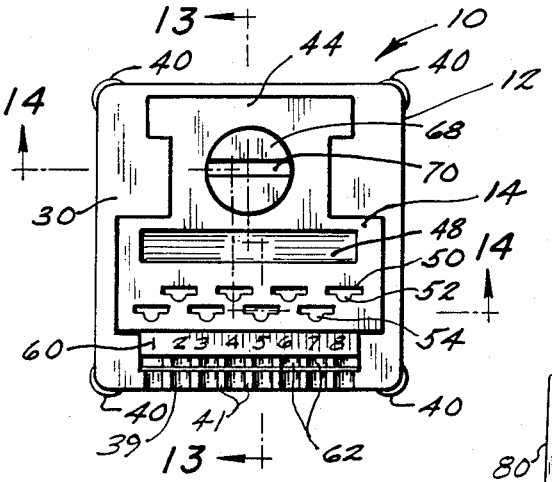
FIG. 12 is a plan view of the assembled electrical connector in accordance with the present invention.

Insert cover 14 further includes a rectangular shelf 60 which is positioned directly below staggered openings 50 and may be used for displaying suitable indicia such as the numbers 1–8 shown in FIG. 12. This indicia can be used to identify the various openings which receive the individual wire leads for insertion into the connector. Shelf 60 terminates short of lower side surface 58 to expose a portion of the lower side surface openings 56 as is clear in FIG. 12. Additionally, a plurality of spacing members 62 are provided on member 58 to provide mechanical and electrical isolation between the individual wire leads during and subsequent to insertion. As shown in FIG. 13B, insert cover 14 includes a pair of upper and lower opposed edges 64 and 66 which respectively mate with shoulders 36 and 38 in housing 12 when connector 10 is in the closed position. Finally, insert cover 14 includes a pair of opposed resilient locking arms 67.

Screw mechanism 16 is essentially cylindrical in shape and includes a head portion 68 having a slot 70 therethrough which is sized to receive the head of a screwdriver. Adjacent head portion 68 is threaded portion 72 which is preferably of a double pitch configuration and of course, mates with the threading of insert cover 14. Below threaded portion 72 is an annular groove 74 having a diameter which is less than that of threaded portion 72. Finally, screw mechanism 16 terminates at a rounded disc portion 76 which is adjacent to groove 74 and which has a diameter preferably equal to the diameter of threaded portion 72. Disc 76 is received in the pair of opposed slots 43 formed in housing 12. The spacing between slots 43 and disc 76 permits disc 76 to freely rotate within the slots. However, it will be appreciated that slots 43 will capture and retain disc 76 (in a lateral sense) despite any rotation therewithin. Threading 72 is engaged and mated to the threading in insert cover 14 so that when screw mechanism 16 rotates clockwise or counter clockwise, disc 76 will also rotate. However, because disc 76 is captured within slots 43 and retained by the housing, insert 14 will move either upwardly or downwardly as the screw mechanism rotates. It will be appreciated that screw mechanism 16 is actuated by a screw driver or the like inserted into slot 70.

Figure 14:
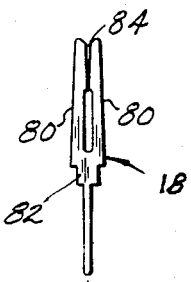
FIG. 14 is a cross sectional elevation view along the line 14—14 of FIG. 12.
Figure 14:
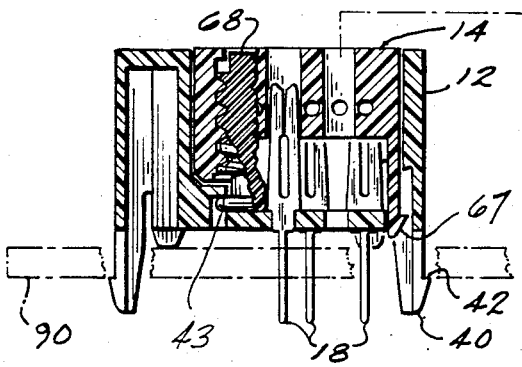

As clearly shown in FIG. 14, terminals 28 comprise a tail portion 78 and a pair of opposed flat arm portions 80 which terminate at a base 82. Tail portion 78 is attached to base 82. Terminals 28 are of a known type and include an insulation displacement slot 84 between the top portions of arms 80. IDC slot 84 operates in a known fashion such that when an insulated wire is passed through slot 84, the insulation on the wire will be displaced and arms 82 will come into intimate contact with the wire within the insulation. Terminals 28 are relatively flat and are positioned through openings 28 in rear face 20 of housing 12 and in openings 52 of insert 14. Terminals 18 are made from any suitable electrically conductive material and are preferably made from a phosphor bronze material. Alternatively, the wire entry portion of adjacent clips 18 may be of a staggered height to reduce the maximum torque required to actuate cover 14 into housing 12.

Figure 13A:
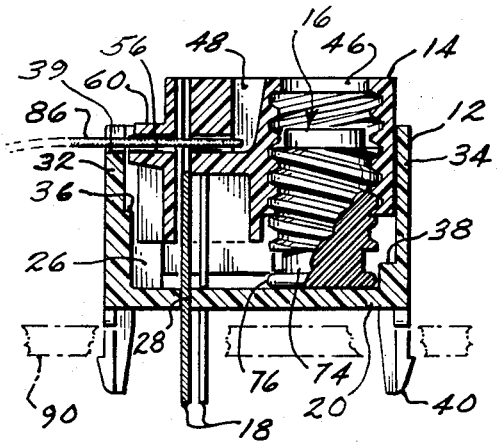
FIG. 13A is a cross sectional elevation view along the line 13—13 of FIG. 12 showing the connector in an open position.
Figure 13B:
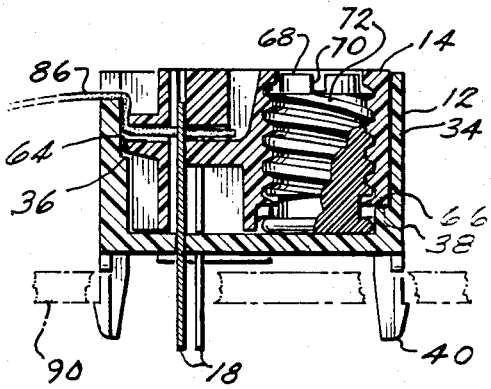
FIG. 13B is a cross sectional elevation view along the line 13—13 of FIG. 12 showing the connector in a closed position.

Referring now to FIG. 13A, assembled electrical connector 10 in accordance with the present invention is shown in an open position. This open position has been achieved by rotating screw mechanism 16 in a counter-clockwise direction so that insert cover 14 is moved outwardly of housing 12 and insert cover openings 56 and grooves 39 are all mutually aligned. Next, an insulated wire lead 86 is inserted into groove 39 and transverse opening 56 in insert cover 14. At this point, IDC slot 84 of terminal 18 will be positioned adjacent to, but spaced from the insulated wire lead 86. Next, and referring to FIG. 13B, thread screw mechanism 16 is again actuated by a screw drive or the like and turned counter clockwise so that insert 14 is driven within cavity 26 of housing 12. It will be appreciated that as insert cover 14 is driven inside housing 12, wire lead 86 will be forced through IDC slot 86 of terminal 18 to make electrical and mechanical connection with terminal 18. In addition, wire lead 86 will bend to a 90° angle by the interaction of insert cover 14 and housing 12. This is a very important feature of Applicants' invention in that the bending of wire lead 86 in a 90° angle will provide strain relief when electrical connector 10 is activated by the screw mechanism 16.

An important feature of the present invention is that the interlocking structures of the I shape portion defined by surface 44 of insert cover 14 and opening 26 in housing 12 resist the natural tendency of the insert and housing to jam due to the movement generated by a load imbalance between the screw mechanism 16 and the termination points at terminals 18.

The insert cover 14 of the present invention provides a quiet electrical front with test access ports 54 for each of the contact positions. Test access ports 54 also act as aids for wire placement to assure proper orientation.

Figure 15:
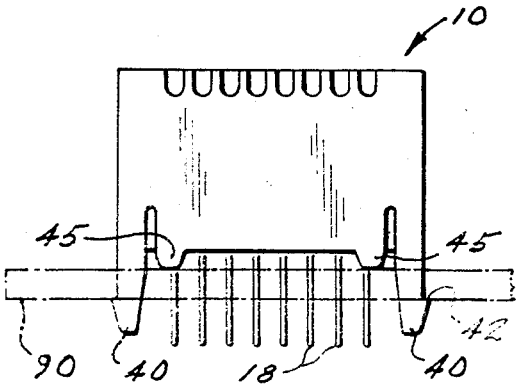
FIG. 15 is a side elevation view of the connector of FIG. 12 showing the connector in a closed position.
Figure 16:
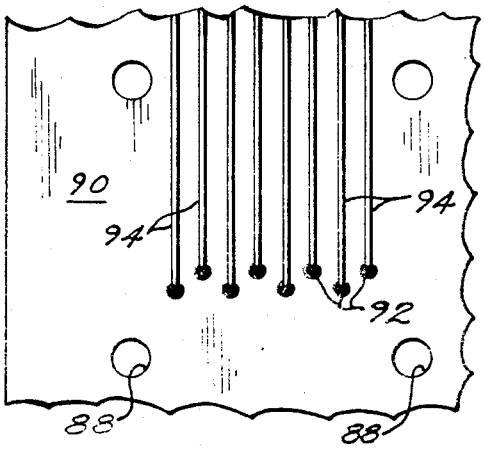
FIG. 16 is a plan view of a printed circuit board suitable for use with the electrical connector of FIG. 12.

Referring now to FIGS. 14–16, electrical connector 10 is mounted to appropriately spaced openings 88 in a circuit board 90 by use of the compliant snap action mounting means 40. Thus, as is shown in FIGS. 14 and 15, mounting means 40 are urged through openings 88 whereby shoulders 42 engage the backside of the circuit board to hold resilient arms 40 in position. At the same time, tails 78 of terminals 18 are each urged through staggered spaced openings 92 in printed circuit board 90. Openings 92 electrically mate with suitable traces 94 in a known fashion. When connector 10 is mounted to PC board 90, standoffs 45 provide a spacing between the connector and the PC board surface for cleaning (e.g. solder flux removal).

In addition to the important features already discussed, the electrical connector 10 of the present invention includes further advantages not found in the prior art. For example, longitudinal groove 48 which communicates with the plurality of transverse openings 56 provide a wire exit means for each of the insulated wire leads loaded into openings 56. Also, the interlock feature 67 on insert cover 14 provides that the insert cover (once assembled to housing 12) will not lift past a given position for wire insertion without undue force on the activation screw mechanism 16. This one-way interlock is accomplished by defeatable latches 67 on each side of the unit.

The electrical connector of the present invention thus provides a housing and cover insert which is used for electrical interconnection of independent wires wherein a captivated screw mechanism is employed to activate and deactivate wire connection to discrete contacts. The present invention includes only three parts (excluding the individual terminals) which leads to relatively low manufacturing and purchasing costs.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An electrical connector comprising:

insulative housing means, said housing means having an opening leading to a housing means cavity, said cavity having a predetermined shape;

insulative insert cover means having a predetermined shape which corresponds to said predetermined shape of said cavity, said insert cover means being received in said cavity of said housing means;

threaded screw means threadably received in said insert cover means, said screw means being captured and retained by screw means retaining means in said housing means; and at least one conductive terminal supported in said housing means and extending into said insert cover means wherein said insert cover means is raised or lowered in said housing means by actuation of said threaded screw means and wherein a wire lead will be simultaneously terminated on said conductive terminal when said insert cover means is lowered.

2. The connector of claim 1 including:

printed circuit board mounting means on an exterior surface of said housing means.

3. The connector of claim 2 wherein:

said mounting means comprises a plurality of resilient arms, each arm having a retaining shoulder.

4. The connector of claim 1 including:

stand-off means on an exterior surface of said housing means.

5. The connector of claim 1 wherein said housing means includes:

at least one hole through a surface thereof for receiving and retaining said at least one conductive terminal.

6. The connector of claim 1 wherein said screw means retaining means comprises:

a pair of opposed grooves which hold and capture said screw means and permit rotation of said screw means.

7. The connector of claim 1 wherein:

said predetermined shape is substantially an I-shape.

8. The connector of claim 1 including:

at least one open-ended slot in said housing means for receiving a wire lead to be connected to said at least one terminal.

9. The connector of claim 1 wherein:

said I-shaped cavity and said I-shaped cover means interlock to resist the tendency of said cover means and housing means to jam.

10. The connector of claim 1 wherein said insert cover means includes:

at least one slot therethrough for receiving said at least one terminal; and at least one transverse opening transverse to said slot for receiving a wire lead, said opening and said slot intersecting.

11. The connector of claim 10 including:

a recess spaced from said slot, said recess communicating with said transverse opening.

12. The connector of claim 1 including:

latch means extending from said insert cover means; and means in said cavity of said housing means for retaining said latch means.

13. The connector of claim 1 including:

shoulder means in said cavity of said housing means, said shoulder means preventing movement of said insert cover means past a preselected location in said housing means.

14. The connector of claim 1 wherein said threaded screw means comprises:

a cylindrical member having opposed first and second ends, said cylindrical member having a threaded section adjacent said first end and an annular section terminating at a disc adjacent said second end, said disc being captured and retained by said screw means retaining means in said housing means.

15. The connector of claim 14 including:

a slot on said first end of said cylindrical member for selective engagement with a turning tool.

16. The connector of claim 1 wherein said terminal comprises:

a flat body having an insulation displacement slot therethrough; and a tail extending from said flat body, said tail extending outwardly of said housing means.

17. The connector of claim 1 including:

strain relief means for reducing strain on a wire lead when the wire lead is terminated to said conductive terminal.

18. The connector claim 17 wherein said strain relief means comprises:

said housing means and said insert cover means cooperating to bend a wire lead about 90 degrees when the wire lead is terminated to said conductive terminal.

19. The connector of claim 16 including a plurality of terminals and wherein:

said terminals have staggered heights to reduce the maximum torque required to actuate said cover means into said housing means.

* * * * *